United States Patent [19]

Baughman et al.

[11] Patent Number: 4,626,156

[45] Date of Patent: Dec. 2, 1986

[54] FINISHING APPARATUS WITH COVER INSERTER

[75] Inventors: Richard C. Baughman; Stephen J. Flamini; William C. Wilson, all of Rochester, N.Y.

[73] Assignee: Eastman Kodak Company, Rochester, N.Y.

[21] Appl. No.: 733,341

[22] Filed: May 13, 1985

[51] Int. Cl.[4] ..... B42B 9/00; B42C 11/02

[52] U.S. Cl. ..... 412/33; 412/4; 412/18; 270/58; 355/14 SH

[58] Field of Search ..... 412/4, 5, 18, 19, 21; 271/9; 270/53, 58; 355/24, 14 SH

[56] References Cited

U.S. PATENT DOCUMENTS 3,153,535 10/1964 Gericke .
3,753,560 8/1973 Kapral et al. .
4,134,672 1/1979 Burlew et al. .
4,330,197 5/1982 Smith et al. .
4,473,425 9/1984 Baughman et al. .

*Primary Examiner*—John Sipos
*Assistant Examiner*—Taylor J. Ross
*Attorney, Agent, or Firm*—G. Herman Childress

[57] ABSTRACT

A finishing apparatus is adapted to receive sheets that are to be formed into booklets from a copier/duplicator or other reproduction apparatus. The sheets are fed along a sheet transport in the finishing apparatus to an assembly station where they are jogged and formed into booklets. The sheets of the booklet may be secured together by staples, an adhesive, or other binding means. The finisher has a covering having an opening directly above support that receives a stack of booklet covers. The covers are fed from the support to the sheet transport for delivery to the assembly station in timed relation to the sheets of the booklet so that the covers are inserted at the front and/or back of the booklet.

1 Claim, 1 Drawing Figure

FINISHING APPARATUS WITH COVER INSERTER

BACKGROUND OF THE INVENTION

This invention relates to finishing apparatus for forming booklets from sets of sheets delivered to the finisher from reproduction apparatus, such as a copier/duplicator, and more specifically to a finisher capable of inserting booklet covers.

Commonly assigned U.S. Pat. No. 4,473,425, issued Sept. 25, 1984, in the names of R. C. Baughman et al and entitled "Binding Apparatus and Method" discloses finishing apparatus in combination with a copier/duplicator. The finishing apparatus receives copy sheets produced on the copier/duplicator seriatim in a particular page sequence, one set of sheets after another. The finisher can produce a booklet from each set of copy sheets by delivering the copy sheets to assembly trays in a particular page sequence. While the booklets can be delivered to a tote tray without securing the sheets together, the patent also discloses finishing of the booklets either by a stitching operation that staples the sheets of the booklet together or by an adhesive binding operation wherein a liquid adhesive is applied to the sheets and the sheets are then stacked and pressed together to form booklets. Cover sheets for the front and/or back of the booklet can be provided from one of the copy sheet supplies of the copier/duplicator as suggested in Column 20, lines 45–50 of the patent.

While apparatus of the type disclosed in that patent has worked well for its intended purposes, the use of one of the copy sheet supplies for cover sheets has certain disadvantages. First of all, it reduces the number of copy sheet supplies that are available for their normal use, i.e., providing copy sheets on which images are formed. In addition, the booklet covers must be transported along the entire conventional copy sheet path through the copier/duplicator. This path normally includes a number of curves which may limit the size, shape, or thickness of cover stock that can be used for formation of booklets. Clearly it would be advantageous to free the copy sheet supplies for their intended use and minimize the length and complexity of the path for booklet covers.

SUMMARY OF THE INVENTION

It is an object of the invention to provide covers for booklets without using one of the sheet supplies of a reproduction apparatus. Another object is to provide for cover insertion in a way which minimizes problems associated with feeding covers of certain sizes, shapes, or thickness through a reproduction apparatus. A further object is to provide for cover insertion in a finisher for booklets wherein the cover supply is conveniently located for the machine operator.

In accordance with the present invention, a finishing apparatus has an assembly station at which booklets are assembled and a sheet transport leading to the assembly station. The sheet transport delivers sets of sheets seriatim to the assembly station. The improvement of the present invention comprises a support for a stack of booklet covers with the support being located in the finisher apparatus adjacent the sheet transport. Means are provided for feeding a booklet cover from the support to the sheet transport for delivery by the transport to the assembly station.

BRIEF DESCRIPTION OF THE DRAWINGS

In the detailed description of the preferred embodiment of the invention presented below, reference is made to the accompanying drawing, in which:

FIG. 1 is a fragmentary cross-section view illustrating a finisher of the present invention in combination with a copier/duplicator or the like.

DESCRIPTION OF THE PREFERRED EMBODIMENT

Figure 1:
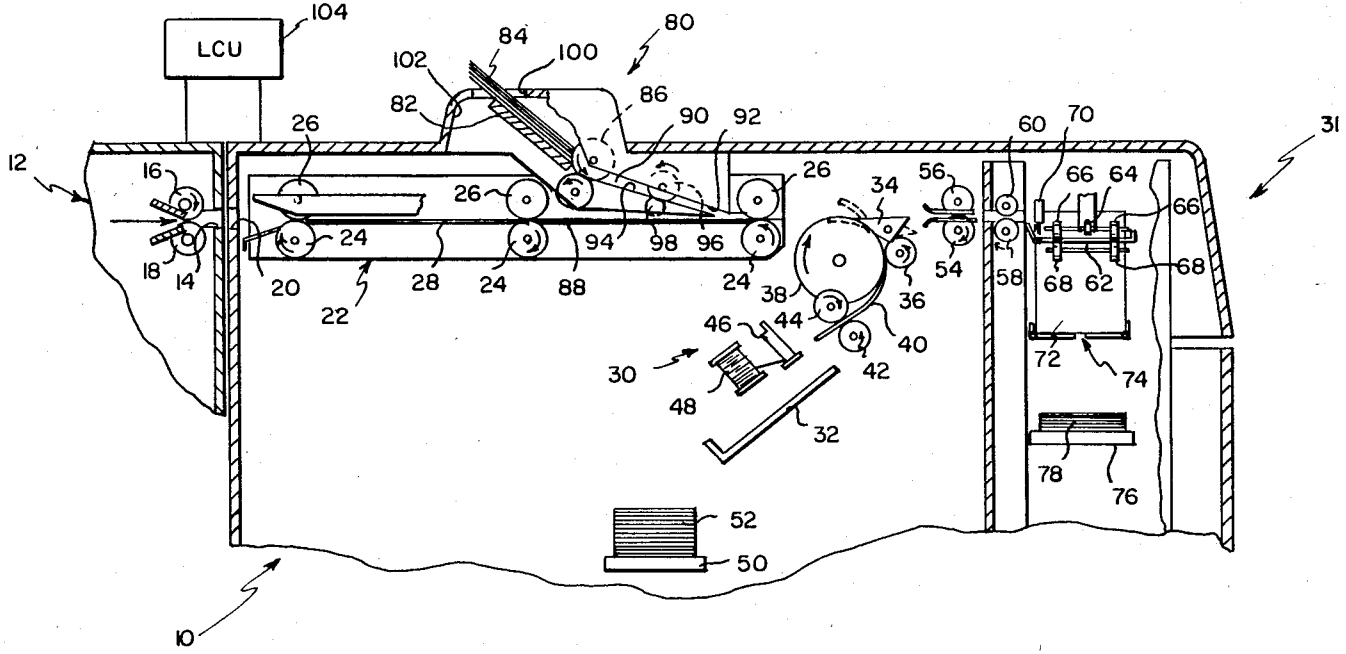

Referring now to the drawings, a finisher generally designated 10 is connected to a copier/duplicator, a portion of which is shown at 12. The copier/duplicator is adapted to produce sets of copy sheets and feed them seriatim to the finisher 12 for forming booklets. More specifically, copy sheets from copier/duplicator 12 are driven by nip rollers 14, 16 through an exit slot 18 of the copier/duplicator and into an entrance slot 20 of finisher 10. Sheets thus fed to the finisher are received by a sheet transport generally designated 22. The sheet transport comprises a plurality of pairs of sheet drive rollers and idler rollers 24 and 26 located on opposite sides of a path for copy sheets. Roller pairs 24, 26 drive copy sheets to the right as viewed in the drawing. The sheets can be supported by suitable guides 28 comprising wire forms, guide plates, or the like. In this manner, copy sheets can be delivered either to a stapler/finisher 30 or an adhesive binder 31 forming portions of the finisher.

Stapler/finisher 30 comprises an assembly tray 32 at which a set of copy sheets are assembled into a booklet. When sheets are to be secured together by stapler/finisher 30, a diverter 34 is moved from its solid line position beneath the path of travel for sheets along the sheet transport to its dotted line position where it is effective to deflect sheets into the nip between rollers 36, 38. These rollers drive the sheets along a sheet guide 40 and into the nip between rollers 42, 44 which deliver the sheets onto the assembly tray 32. As known in the art, sheets on tray 32 can be jogged and then are secured together by a stapler or a stitching mechanism 46 using wire supplied from a roll 48. When a booklet has been formed in tray 32 and either stapled or left unstapled, the booklet is removed from the tray and deposited onto a collection tray 50. Stacks of booklets 52 can be accumulated on tray 50 and removed at the convenience of the machine operator. For a more detailed description of the stapler/finisher 30 and its association with a copier/duplicator, reference is made to the before-mentioned U.S. Pat. No. 4,473,425, and commonly assigned U.S. Pat. No. 4,134,672, issued Jan. 16, 1979, in the names of L. E. Burlew et al and entitled "Copier Finisher for an Electrographic Reproducing Device." Stapler/finisher portion 30 can be constructed as disclosed in these patents and, accordingly, the disclosure in such patents is hereby incorporated by reference.

When sheets are to be finished by an adhesive binding process, diverter 34 remains in its lowered, solid line position so that sheets leaving rollers 24, 26 pass over the diverter and thus are delivered to the sets of sheet transport rollers 54, 56, 58, and 60. Sheets delivered to the binder 31 are received by a tray 62 and immediately driven rearwardly by a puck drive 64 into the nip between upper and lower pairs of drive rollers 66 and 68. As the sheet travels rearwardly, it passes beneath the nozzle of an adhesive applicator 70 which is cycled on and off at the appropriate time to apply adhesive to each sheet of a set of sheets except the first sheet of the set. The sheets driven rearwardly by the roller 66, 68 engage and travel around a curved sheet guide 72 that inverts the sheets and deliver them to an assembly tray 74. The sheets are stacked one above another in tray 74, jogged, and periodically pressure is exerted on the area of the sheets above the stripe of adhesive to thereby form a booklet from each set of sheets delivered to the binder 31. When a booklet has been formed, it is deposited onto a collection tray 76 immediately beneath the assembly tray 74. The booklets thus formed are designated 78 in the drawings. For more details of a particular binder construction that can be used for binder 31, reference is made to the before-mentioned U.S. Pat. No. 4,473,425, the disclosure of which is incorporated herein by reference.

In accordance with the present invention, the finisher 10 has cover inserter apparatus generally designated 80 for feeding booklet covers directly to the stapler/finisher 30 or the adhesive binder 31 of the finisher. Apparatus 80 comprises a tray 82 that supports a plurality of booklet covers 84 in an inclined position generally at a 45-degree angle to a horizontal plane. At the lower end of the tray 82, there is a cover feeding mechanism comprising a pair of drive rollers 86 and 88, both of which are driven in a counterclockwise direction as viewed in the drawings. Sheet feeding mechanisms of this general type of well-known in the art. By driving both rollers in the same direction, the upper roller 86 is effective to remove and drive a cover 84 from the tray 82 while roller 88 is effective to prevent feeding of more than one cover at a time from the stack in the tray.

Covers removed from the tray by rollers 86, 88 are driven into a sheet path 90 defined by sheet guides 92, 94. Sheet path 90 leads from the tray to the path taken by copy sheets driven along the sheet transport 22. Depending on the length of path 90, additional drive rollers 96, 98 can be provided for making certain that covers are driven to rollers 24, 26 of the sheet transport 22. Path 90 intersects the sheet transport 22 upstream of diverter 34. Thus a cover removed from the tray 82 can be delivered either to the stapler portion 30 or to the adhesive binder 31 by sheet transport 22. Also, path 90 is inclined at a small oblique angle to the sheet transport 22 so that a cover does not encounter any short turns as it makes the transition from the path to the sheet transport.

Cover inserter apparatus 80 preferably is located at the top portion of finisher 10 and above the sheet transport 24 so that it is easily accessible to an operator for loading covers 84 into the tray. In the particular embodiment illustrated in the drawing, an opening 100 is provided in a projecting portion 102 of the cover for the finisher, the opening 100 being directly above the tray 82. Thus, a machine operator can easily place a stack of covers 84 on tray 82. However, the cover feed mechanism comprising rollers 86, 88 and other apparatus within the housing for the finisher 10 are substantially enclosed so that the operator cannot inadvertently contact and be injured by the moving parts of the apparatus.

The finisher 10 and copier/duplicator 12 preferably are controlled by a logic and control unit 104. A single logic and control unit can be used for both pieces of apparatus, as illustrated in FIG. 1, or the copier and finisher can have separate logic and control units that are functionally coupled together for operation as described in the before-mentioned U.S. Pat. No. 4,473,425. As known in the art, such logic and control units are capable of timing various portions of the apparatus, sensing the movement of sheets, etc, in order to provide a programmed, timed relationship between various events.

In operation, copier/duplicator 12 is operated in a known manner to produce sets of copies that are delivered to finisher 10 through inlet 20 and thereby provided to sheet transport 22. Preferably, the sheets of each set are delivered seriatim with the last page or sheet of the set being delivered first followed by successive ones of the sheets in page sequence order so that the last sheet contains the first page of the booklet to be formed and the first sheet delivered to the finisher 10 contains the last page of information in the booklet. Such is described in more detail in the before-mentioned U.S. Pat. No. 4,473,425.

Through an operator control panel (not shown), a machine operator may indicate to the LCU that covers are to be provided with each booklet, either a top cover, a bottom cover, or both a top and a bottom cover. The operator loads a stack of the covers 84 on tray 82. At the proper time in the machine cycle, the logic and control unit 104 operates drive rolls 86, 88 to feed a cover 84 from tray 82 through path 90 to sheet transport 22. Thus, a back cover is fed immediately before the first sheet of a set that is delivered to the finisher 10, and a front cover of a set is delivered immediately after the last sheet of a set of sheets is delivered to the finisher 10. The covers are transported by sheet transport 22 either to the stapler/finisher 30 or the adhesive binder 31 by the sheet transport and fed to one of the assembly trays 32, 74.

Covers 84 may be blank or they may have printed information thereon. If printed information is contained on the covers, the printed information that is to be visible on the outside of the front cover of the booklet is located face down on tray 82 whereas printed information to be visible on the outside of the back cover of the booklet is located in a face-up relationship on tray 82. Where both front covers and back covers are to be provided, the covers are interleaved alternately in the stack of covers 84 on tray 82.

The apparatus of the present invention provides a number of desirable advantages. First of all, by providing a separate tray 82 in the finisher for the covers, covers do not need to occupy the sheet supplies of copier/duplicator 12 that normally receive blank copy sheets. Thus the sheet supplies can be freed for their intended use as copy sheet supplies. This is desirable, especially in high-speed duplicators, where the duplicator can automatically shift from one sheet supply to another when a sheet supply becomes exhausted of copy sheets. In addition, the cover sheets do not need to pass through the copier/duplicator 12 and thereby are less likely to cause jams, especially when the covers are formed from relatively heavy paper stock. Another advantage is that tray 82 is visible and very convenient to the machine operator. Thus it is easy to determine when the supply of covers in tray 82 need replenished, and convenient for the operator to add covers. Also, the sheet path for the covers is very short and has few turns on bends. This reduces the chance of jams along the path, and simplifies clearance of jams. Moreover, the covers can be of a size, shape, etc, that would not feed reliably through the path for copy sheets along the copier/duplicator.

The invention has been described in detail with particular reference to a preferred embodiment thereof, but it will be understood that variations and modifications can be effected within the spirit and scope of the invention.

We claim:

1. In a finishing apparatus having an assembly station at which booklets are assembled, and the finishing apparatus having a sheet transport defining a first path leading to the assembly station, the sheet transport being adapted to deliver sets of sheets seriatim to the assembly station, the improvement comprising:

a support in the finishing apparatus for holding a stack of booklet covers, the support being located above the sheet transport and inclined at an angle relative to the sheet transport, means for feeding booklet covers from the support and along a second sheet path extending from the support to the first path so that booklet covers can be delivered from the support to the assembly station, and the finishing apparatus having a cover enclosing the sheet transport and the feeding means, the cover having an opening directly above the support and of sufficient size to allow an operator to place a stack of booklet covers onto the support without opening the cover.

* * * * *